US006470803B1

(12) United States Patent
Liu et al.

(10) Patent No.: US 6,470,803 B1
(45) Date of Patent: Oct. 29, 2002

(54) BLASTING MACHINE AND DETONATOR APPARATUS

(75) Inventors: Liqing Liu; Michael Norman Lussier, both of Calgary (CA)

(73) Assignee: Prime Perforating Systems Limited, Calgary ( * ) Notice: Subject to any disclaimer, the term of this patent is extended or adjusted under 35 U.S.C. 154(b) by 0 days.

(21) Appl. No.: 09/686,896

(22) Filed: Oct. 12, 2000

Related U.S. Application Data

(62) Division of application No. 08/992,412, filed on Dec. 17, 1997, now abandoned.

(51) Int. Cl.[7] ..... F23Q 7/02
(52) U.S. Cl. ..... 102/206; 102/218
(58) Field of Search ..... 361/247; 102/200, 102/202, 202.8, 202.9, 202.11, 275.6, 218, 220, 322, 206

(56) References Cited

U.S. PATENT DOCUMENTS

| | | | |
|---|---|---|---|
| 2,703,053 | A | 3/1955 | Castel |
| 2,933,653 | A | 4/1960 | Carter |
| 3,185,093 | A | 5/1965 | Holinbeck |
| 3,638,302 | A | 2/1972 | Wilk |
| 3,682,098 | A | 8/1972 | Spies |
| 3,762,331 | A | 10/1973 | Vlahos |
| 4,004,251 | A | 1/1977 | Hesler et al. |
| 4,141,297 | A | 2/1979 | Sellwood |
| 4,145,968 | A | 3/1979 | Klein |
| 4,145,970 | A | 3/1979 | Hedberg et al. |
| 4,207,796 | A | 6/1980 | Warnock |
| 4,273,051 | A | 6/1981 | Stratton |
| 4,297,947 | A | 11/1981 | Jones et al. |
| 4,304,184 | A | 12/1981 | Jones |
| 4,378,738 | A | 4/1983 | Proctor et al. |
| 4,422,378 | A | 12/1983 | Plichta |
| 4,422,379 | A | 12/1983 | Geller et al. |

(List continued on next page.)

FOREIGN PATENT DOCUMENTS

| | | |
|---|---|---|
| CA | 1126370 | 6/1982 |
| CN | 87103475 | 5/1987 |
| CN | 88207276 | 6/1988 |
| CN | 90202672 | 3/1990 |
| CN | 91217225 | 7/1991 |
| FR | 2586800 | 3/1987 |

OTHER PUBLICATIONS

Motley, Jerry; Barker, James, "Unique Electrical Detonator Enhances Safety in Explosive Operations: Case Histories", SPE 36637 1996.

Liu, Liqing, "Develop an Electromagnetic Induction Initiation System for Explosive Devices for the Oil Industry", Jan. 31, 1997.

Liu, Liqing, "Further developments of the concept of electro magnetic induction initiation", Proceedings of the International Congress on Mine Design, Kingston, Ontario, Canada, Aug. 23–26, 1993.

*Primary Examiner*—Charles T. Jordan
*Assistant Examiner*—Daniel Matz

(57) ABSTRACT

Detonator apparatus, such as a blasting machine detonator, is provided with a miniature transformer having multi-turn primary and secondary coils. The transformer feeds a bridge wire detonator element, and has sufficient impedance to permit impedance matching with a carrier that may be as long as 7500 m. The impedance of the detonator is such that the detonator resists firing when subject to stray currents or commonly present power or communications signals. A blasting machine is provided that is specifically designed to provide a signal having a frequency in the range in which the detonator is sensitive. The blasting machine relies upon semi-conductor switching and timing circuits to control the discharge from a pair of capacitors, rather than upon an output transformer.

35 Claims, 11 Drawing Sheets

U.S. PATENT DOCUMENTS

| | | | | | |
|---|---|---|---|---|---|
| 4,423,343 | A | | 12/1983 | Field, II | |
| 4,425,849 | A | | 1/1984 | Jorgenson | |
| 4,441,427 | A | | 4/1984 | Barrett | |
| 4,445,435 | A | * | 5/1984 | Oswald | 102/206 |
| 4,451,867 | A | * | 5/1984 | Robertson | 361/248 |
| 4,482,858 | A | | 11/1984 | Plichta | |
| 4,519,314 | A | | 5/1985 | Jorgenson | |
| 4,522,671 | A | | 6/1985 | Grunwald et al. | |
| 4,544,035 | A | | 10/1985 | Voss | |
| 4,601,243 | A | | 7/1986 | Ueda et al. | |
| 4,649,821 | A | | 3/1987 | Marshall et al. | |
| 4,700,263 | A | | 10/1987 | Marshall et al. | |
| 4,708,060 | A | | 11/1987 | Bickes, Jr. et al. | |
| 4,712,477 | A | * | 12/1987 | Aikou et al. | 102/202.5 |
| 4,777,878 | A | | 10/1988 | Johnson et al. | |
| 4,806,928 | A | | 2/1989 | Veneruso | |
| 4,843,964 | A | | 7/1989 | Bickes, Jr. et al. | |
| 4,848,232 | A | | 7/1989 | Kurokawa et al. | |
| 4,852,493 | A | | 8/1989 | Boberg et al. | |
| 5,122,714 | A | | 6/1992 | Chermin et al. | |
| H1366 | H | | 11/1994 | Bickes, Jr. et al. | |
| 5,363,765 | A | * | 11/1994 | Aikou et al. | 102/206 |
| 5,435,248 | A | * | 7/1995 | Rode et al. | 102/206 |
| 5,503,077 | A | | 4/1996 | Motley | |
| 5,505,134 | A | | 4/1996 | Brooks et al. | |
| 5,602,713 | A | * | 2/1997 | Kurogi et al. | 361/249 |
| 6,082,265 | A | * | 7/2000 | Sakamoto et al. | 102/206 |
| 6,085,659 | A | * | 7/2000 | Beukes et al. | 102/200 |
| 6,268,775 | B1 | * | 7/2001 | Patti | 331/111 |

* cited by examiner

BLASTING MACHINE AND DETONATOR APPARATUS

RELATED CASES

The present patent application is a divisional of and claims the benefit of patent application Ser. No. 08/992,412 filed on Dec. 17, 1997, now abandoned, the subject matter of which is incorporated by reference herein.

FIELD OF THE INVENTION

The present invention relates generally to an apparatus and method for remotely activating blasting devices. Such an apparatus and method may be used, for example, in oil and gas well production in other industries in which remote initiation of explosive devices occurs.

BACKGROUND OF THE INVENTION

In the production of oil and gas from underground wells, it is known to convey a perforating gun on a wireline down a bore hole of a well to a position where an oil or gas bearing stratum is located, and then to detonate shaped charges in the perforating gun. The shaped charges penetrate the formation, facilitating the entry of oil or gas into the well.

Safe and reliable initiation of perforating guns or other firing devices in the well-bore, far removed from the surface, has been a continuing source of design challenges. The explosive train in the perforating gun normally comprises a detonator for setting off a detonating cord. The cord in turn detonates a series of connected shaped charges. The detonator is the first element in the explosive train and is normally the most sensitive to external stimulation. Generally speaking, the safety level of the perforating gun is primarily determined by the safety level of the detonator used. Bridge wire electric detonators have been, and are widely used. When an electric current of sufficient strength is applied to its lead wires the bridge wire is heated and ignites the pyrotechnic material surrounding it. This in turns sets off the primary and secondary explosive charges in the detonator.

An inherent problem with bridge wire detonators is the risk of unintentional detonation which may arise from stray currents. A bridge wire detonator does not possess the ability to distinguish between firing current and hazardous electric energy that reaches its lead wires. Typical sources of electrical interference which may cause unintentional detonation are communications equipment, whether cellular telephones or radio, standard 220V, 50 Hz or 110V, 60 Hz line current, electrostatic discharges and lightning. At present when bridge wire detonators are used for perforating jobs, typical safety measures include shutting down electric sources in the well rig environment and turning off communication facilities. It would be advantageous to provide the oil industry a method of initiating perforating guns and a detonator which reduces or eliminates the need to suspend the use of without suspending the electric devices and communication radio in the well rig environment. An additional problem concerns unauthorized use of the detonators. Lost, stolen or mishandled detonators that can be set off by commonly available power sources, whether deliberately or accidentally used, may pose a significant danger. It would be advantageous to have a detonator which will resist detonation except when initiated by an authorized person using a specially designed blasting machine.

A known approach to the problem of unintentional detonation is to add extra resistance in series with the bridge wire, making a "resistorized detonator". A higher voltage than would otherwise be required is used to fire a resistorized detonator, making it more difficult to set off. However, the magnitude of the electric current needed to initiate the detonator remains the same as non-resistorized detonators.

Another approach is to increase both the voltage and electric current needed to fire the detonator, so that they substantially exceed the upper limit of routine well rig electrical signals like the exploding bridge wire detonator or exploding foil detonator. This kind of exploding bridge wire or exploding foil detonator is disclosed in U.S. Pat. No. 4,777,878 of Johnson et al. issued Oct. 18, 1988 and U.S. Pat. No. 5,505,134 of Brooks et al., issued Apr. 9, 1996. Another approach, as shown in U.S. Pat. No. 4,708,060 of to Bickes et al., issued Nov. 24, 1987 and U.S. Pat. No. 5,503,077 of Motley issued Apr. 2, 1996, employs a semiconductor bridge wire to achieve improved safety.

Still another method is to isolate the bridge wire, by employing a small transformer in the detonator. The load, generally the bridge wire of the detonator, is connected to the secondary winding of the transformer to form a loop and is electrically isolated from the primary winding of the transformer. The core material of the transformer is chosen to attenuate, or eliminate, spurious electrical power and radiofrequency signals and to respond to firing currents falling within a predetermined range of magnitude and frequency. A blasting machine provides electric current in the predetermined range needed to fire these inductive detonators.

A number of embodiments of transformer based detonators are shown in U.S. Pat. No. 4,273,051 of Stratton, issued Jun. 16, 1981. All of those embodiments employ some form of auxiliary energy dissipation means, whether a series or other leakage inductance, a fusible link, or a resistor in parallel with the primary winding.

Another example of a ferrite core, broad band attenuator is shown in U.S. Pat. No. 4,378,738 of Proctor et al., issued Apr. 5, 1983. U.S. Pat. No. 4,441,427 of Barrett, issued Apr. 10, 1984 discloses an oil well detonator assembly that uses ferrite materials to protect against radio frequency energy.

U.S. Pat. No. 4,544,035 of Voss, issued Oct. 1, 1985 discloses the use of two coils to initiate a detonator in a perforating gun without the coupling of magnetic materials. U.S. Pat. No. 4,806,928 of Veneruso, issued Feb. 21, 1989 discloses the use of coil assemblies arranged on ferrite cores for data transmission between well bore apparatus and the surface and which may also be used to fire perforating guns.

U.S. Pat. No. 3,762,331 to Vlahos, issued Oct. 2, 1973 discloses a firing circuit for detonators that uses a step down transformer having a voltage reduction of roughly 100:1 and a secondary coil having only 1 or 2 turns. It operates at a voltage between 60V and 240V and at a signal frequency of the order of 10 KHz. It is powered by a battery in parallel with a storage capacitor, which discharge through an inverter circuit which includes a solid state oscillator and a transformer for stepping up the resulting a.c. voltage to the desired level. This patent also discloses the use of shunt and series capacitance connected to the primary winding of the detonator, and a large step down at the detonator transformer. U.S. Pat. No. 4,145,968 to Klein, issued Mar. 27, 1979 describes primary and secondary windings and a fixed magnetic screen designed to be saturated in the presence of the magnetic flux generated by the primary winding. U.S. Pat. No. 4,297,947 to Jones et al., issued Nov. 3, 1981 discloses the use of a toroid or a magnetic core with removable parts as transformer cores to couple a relatively short (100 m) firing cable and a number of detonators.

U.S. Pat. No. 4,304,184 to Jones issued Dec. 8, 1981 discloses a transformer circuit whose primary and secondary windings are not completely isolated. Instead, they are coupled not only magnetically but also electrically. While this configuration may provide protection against hazardous electrical currents at low values and low frequencies, the safety features would be more satisfactory if the two windings were completely isolated electrically. None of the transformer-based detonators noted above appear to be suitable for oil well use.

A detonator that can be used in the oil industry at great depth poses special requirements for the coupling transformer. The electric energy supplied from the surface is transmitted along the wireline cable down oil wells as deep as 7,500 m. The cable used for well logging and casing perforation may not be designed for high frequency transmission. The distributed shunt capacitance along the cable is in the order of 0.15 uF/Km. The attenuation for high frequency electrical energy is as high as 3 db/Km (at 20 KHz). Consequently, for effective power transmission along the wireline, a relatively low frequency is preferred. However, electric currents having a frequency lower than 1 KHz will be attenuated by the ferrite core transformer and may not yield a suitable output for energizing the bridge wire in the secondary winding. Therefore, frequency significantly higher than 1 KHz is preferable and the blasting machine must be powerful enough to allow energy dissipation along the wire-line and still secure reliable initiation of the detonator. For optimum power transmission, the inductance of the transformer used in the detonator must be in a certain range at a certain firing current frequency. The inductance of a transformer of some typical known designs may fall in the range of 1–50 $\mu$H. Inasmuch as the characteristic impedance of a typical monocable used in well logging is about 30–50Ω, usable for oil well wirelines.

By contrast, a transformer having a relatively high primary inductance in the order of 40 mH, would be unsuitable even at the lowest usable frequencies. Also, where the step down is too large, the relatively high voltage needed to fire the detonator makes it impractical for oil well use because of the rapid attenuation of the high frequency voltage signal along the cable. In the view of the inventors of the present invention, the preferred frequency range for effective power transmission is between 3 and 20 KHz, and the primary inductance of the transformer should be in the range of 200 $\mu$H and 3 mH.

A number of the transformers noted above use magnetic cores which provide a closed magnetic circuit. Some of them may have removable parts to accommodate the firing cable and detonator legwires, as disclosed by U.S. Pat. Nos. 4,297,947 or 4,601,243. When the primary inductance needed is small and a relatively big transformer core (for example, a toroid having outer diameter of 20 mm, placed outside the detonator body) is used, a few turns of winding may be sufficient. However, for a higher impedance the number of winding turns is relatively large, normally in the range 15–80 for the primary winding, depending on the actual size and material properties of the transformer core. Generally the core size of the transformer should be comparable to that of the outside diameter of the detonator. For an oil well detonator this dimension is commonly about 6–7 mm. In the view of the present inventors, as a practical matter, it is difficult efficiently to wind such a large number of turns on a small transformer core, such as a toroid.

In the view of the inventors, some of these difficulties may be addressed by using a transformer constructed with a simple core in the form of a column having the desired number of primary and secondary windings on it. A column represents an open magnetic circuit. To achieve efficiency in manufacturing, especially in mass production, it would be advantageous to form the primary and secondary windings by winding separate coils, and then be assembling those coils onto the column shaped core. Alternatively, the primary and secondary windings could be wound on a simple machine sequentially, with the primary winding be embedded, or nested, within the secondary winding, or vice versa. Different shapes of the column can be used, such as a square column, a plate, a tube, a U-shaped core, or other suitable form.

In an open magnetic circuit, there is energy loss associated with the high magnetic resistance. It would be advantageous to reduce this loss by using another piece of magnetically permeable material to form a closed magnetic circuit transformer core. Examples of such materials are nickel-iron alloys or permalloys and silicon steel, which have a high magnetic permeability, high curie temperature and are small in volume, low in cost and flexible to form different shapes as required.

The oil well use of a transformer-based detonator presents technical challenges. In addition to the extremely long transmission distance (up to 7,500 m long) discussed previously, the high temperature environment also tends to present design challenges. Firstly, magnetic permeability of the core changes with increases in temperature, and drops to near zero above the Curie temperature. Magnetic materials lose their magnetism and the ability to transmit signals beyond the Curie temperature. Advantageously, magnetic materials chosen for transformer cores should have a Curie temperature higher than the highest anticipated temperature in the well, typically 180° C. or higher. Secondly, the ability of most magnetic materials to transmit energy decreases substantially with the increase in temperature due to the decrease in saturation flux density. For example, for a typical maganese-zinc ferrite material, the saturation flux density at room temperature is 4500 Gauss. This decreases to 1750 Gauss when the ambient temperature is 200° C. It is advantageous for the transformer detonator to be able to transmit the required amount of initiation energy at reduced saturation flux density. Thirdly, for ferrite materials there is generally an optimum temperature point at which the core loss at a minimum. Deviation in temperature from that point would result in increased core loss. Even though the detonation location well temperature may vary, it is advantageous to choose a ferrite material which has an optimum core loss temperature close to the expected well temperature.

A blasting machine is an electronic device which sends a high frequency electric signal through the wireline to fire the detonator. It is advantageous to provide a blasting machine whose output characteristics match the preferred frequency range of the detonator.

U.S. Pat. No. 4,422,378 discloses an ignition circuit for firing detonators having a toroid transformer. It uses a power oscillator having a transistor to provide a firing signal at the resonant frequency of a network of detonators, the transistor being controlled by a current feedback signal. This self-adjusting resonance matching is possible when the inductance and capacitance of the detonators connected in a net are detectable. In some applications, such as those in which diodes are placed in series with the wireline, the inductance of the line can not be obtained and it is difficult automatically to generate the resonant frequency.

U.S. Pat. No. 4,422,379 discloses another ignition circuit for firing detonators with a toroid transformer. The oscillator of the circuit is a typical push-pull power amplifier with the use of an output transformer. U.S. Pat. No. 4,848,232 also uses a firing circuit in the form of a push-pull power amplifier with an output transformer.

In U.S. Pat. No. 4,601,243, the electrical charge stored by a capacitor is discharged to detonators through a high frequency converting unit which oscillates at a frequency between 50 KHz and 1 MHz.

The above referenced U.S. patents commonly have an output transformer. It would be advantageous to eliminate the use of such an output transformer in the blasting machine. First, power output tends to be limited by the size of the transformer. Long transmission distances or initiation of many detonators in one round tends to require a relatively big transformer. This weight and size disadvantage tends to be more pronounced at relatively lower frequencies such as the 3–20 KHz range noted above. When a large, heavy transformer is used the manufacturing cost also tends to increase.

It would be advantageous to have an electrically activated detonator operable at great distances, from an electrical signal source, such as may be desired for perforation of an oil well thousands of meters from the surface.

It would be advantageous to have a simplified, electrically activated detonator that is relatively insensitive to signals from common electrical sources such as radios, telephones, 50 and 60 Hz supply signals, and other stray or static signals.

It would be advantageous to have a blasting machine for activating remote detonators that does not require the use of a large, heavy, and expensive iron core output transformer.

SUMMARY OF THE INVENTION

The present invention provides, in a first aspect, a detonator for igniting explosive material comprising a multi-turn primary coil for connection to a detonation signal source; a multi-turn secondary coil connected to an explosive igniting element; and a core magnetically linking the coils. The core has a mandrel upon which at least one of the coils is mounted.

In a second aspect of the invention there is a detonator for use in a well perforating gun comprising a transformer having a pair of multi-turn coils linked by a magnetically permeable core. The core has a mandrel. One of the coils is a pre-formed coil mounted upon the mandrel. One of the coils is connectible to a detonation signal source and the other coil is connected to an explosive igniting element with which it forms a closed circuit. Explosive material is in contact with the explosive igniting element.

The invention may also have a magnetically permeable closure member fit to the mandrel to form a closed loop magnetic circuit. Each of the coils may be a pre-formed coil. Each of the coils may be mounted on a mandrel of the core. The detonator may have closure member fit to each mandrel to form a closed loop magnetic path.

In a still further aspect of the invention there is an assembly for causing an explosive charge to explode comprising a blasting machine for generating a detonation signal; a detonator for receiving a detonation signal; and a carrier for carrying a detonation signal from the blasting machine to the detonator; the detonator having a transformer having a pair of multi-turn coils linked by a magnetically permeable core, one of the coils being connectible to the signal carrier; an explosive igniting element connected to the other coil to form a closed circuit; explosive material in contact with said explosive igniting element; and the core having at least one mandrel, and at least one of the coils being a pre-formed coil mounted on the mandrel.

In a further aspect of that invention, the blasting machine of the explosive assembly further comprises an energy storage system; a discharge system for releasing energy from the storage system; a switching system operable to control the discharge system to release the detonation signal from the energy storage system for communication of the signal to the detonator along the carrier.

In an even further aspect of the invention there is a blasting machine for producing a specific signal for setting off a signal selective detonator, comprising a charge storage system; an output port for connection to the signal selective detonator; a switching system connected between the charge storage system and the output port; a pre-set discharge control system operable to vary flow of charge through the switching system to produce the specific signal.

In further aspect of that even further aspect of the invention, the blasting machine further comprising a charging system selectively connectible to the charge storage system when the discharge control system is inoperative.

In another further aspect of that even further aspect of the invention the charging system includes a transformer connectible to draw power from a standard line source, and a rectifier connected to the transformer for converting the power to a form storable in the charge storage system.

In yet another aspect of the invention there is a detonator for igniting explosive material comprising a primary winding for connection to a detonation signal source; a secondary winding and an explosive igniting element connected thereto; and a core magnetically linking the primary and secondary windings. The core has a first portion made from a first magnetically permeable material for attenuating signals in a first frequency range, and a second portion made from a second magnetically permeable material for attenuating signals in a second frequency range.

In a still further aspect of the invention a detonator for igniting explosive material comprises a multi-turn primary coil for connection to a detonation signal source and a multi-turn secondary coil and an explosive igniting element connected thereto. The coils are co-axially mounted and magnetically coupled by a core of low magnetic permeability.

BRIEF DESCRIPTION OF THE DRAWINGS

For a better understanding of the present invention and to show more clearly how it may be carried into effect, reference will now be made by way of example to the accompanying drawings, which show an apparatus according to the preferred embodiment of the present invention and in which.

DETAILED DESCRIPTION OF THE PREFERRED EMBODIMENT

The description of the invention is best understood with reference to the figures, in which some proportions have been exaggerated, or shown in schematic form for the purposes of conceptual illustration.

Figure 1:
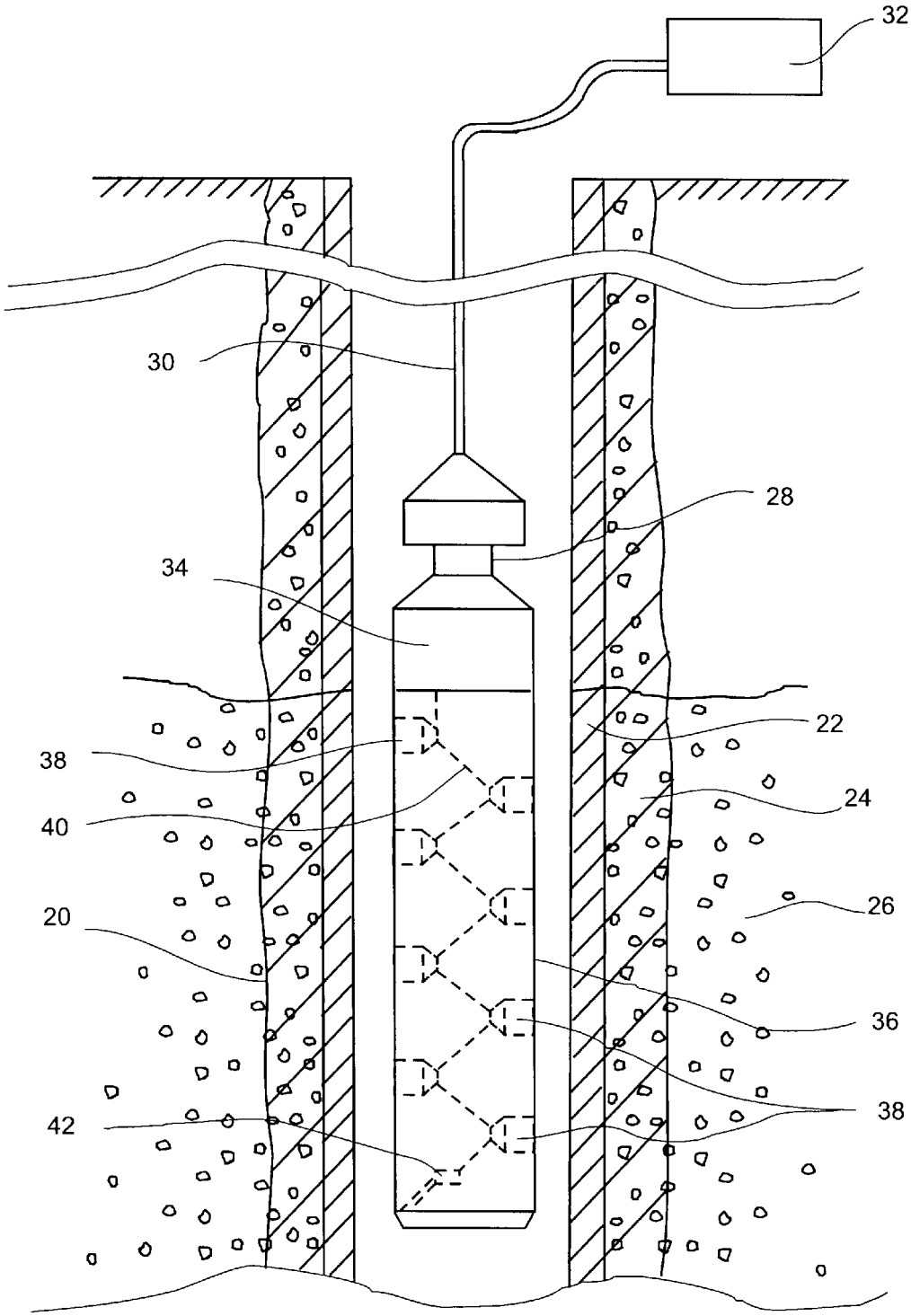
FIG. 1 is a general schematic drawing indicating the general relationship of a blasting machine, a detonator and a perforating gun in the context of the present invention.

The blasting machine of the preferred embodiment is useful, for example, in the oil industry for oil well casing perforation. As such, with reference to FIG. 1, a well bore, such as may be made for an oil, gas or other well, is shown as 20. It has an inner steel casing 22, with a more or less annular concrete filling 24 between casing 22 and bore 20. A formation, or stratum of oil bearing rock is indicated as 26. A perforating gun assembly 28 has been conveyed down bore 20 on the end of a wireline 30 by which it is physically located in the well. The distance down the well may be 1000 m, or more, up to 7,500 m beneath the ground surface. Wireline 30 also electrically connects assembly 28 with a high frequency blasting machine 32 located on the surface.

Perforating gun assembly 28 has at its upper end a collar locator 34 to which wireline 30 is attached. Depending therefrom, perforating gun assembly 28 includes a tube 36 containing a series of shaped charges 38 connected to a detonating cord 40. Cord 40 terminates at a detonator 42 by which cord 40, and then charges 38 are ignited. In use, an electrical signal originating at blasting machine 32 is delivered along wireline 30 to detonator 42. When detonator 42 is set off, it in turn sets off cord 40 which detonates charges 38. The jets formed by charges 38 penetrate steel casing 22, concrete filling 24 and oil bearing stratum 26 to establish communication between the well and the rock formation.

Figure 2:
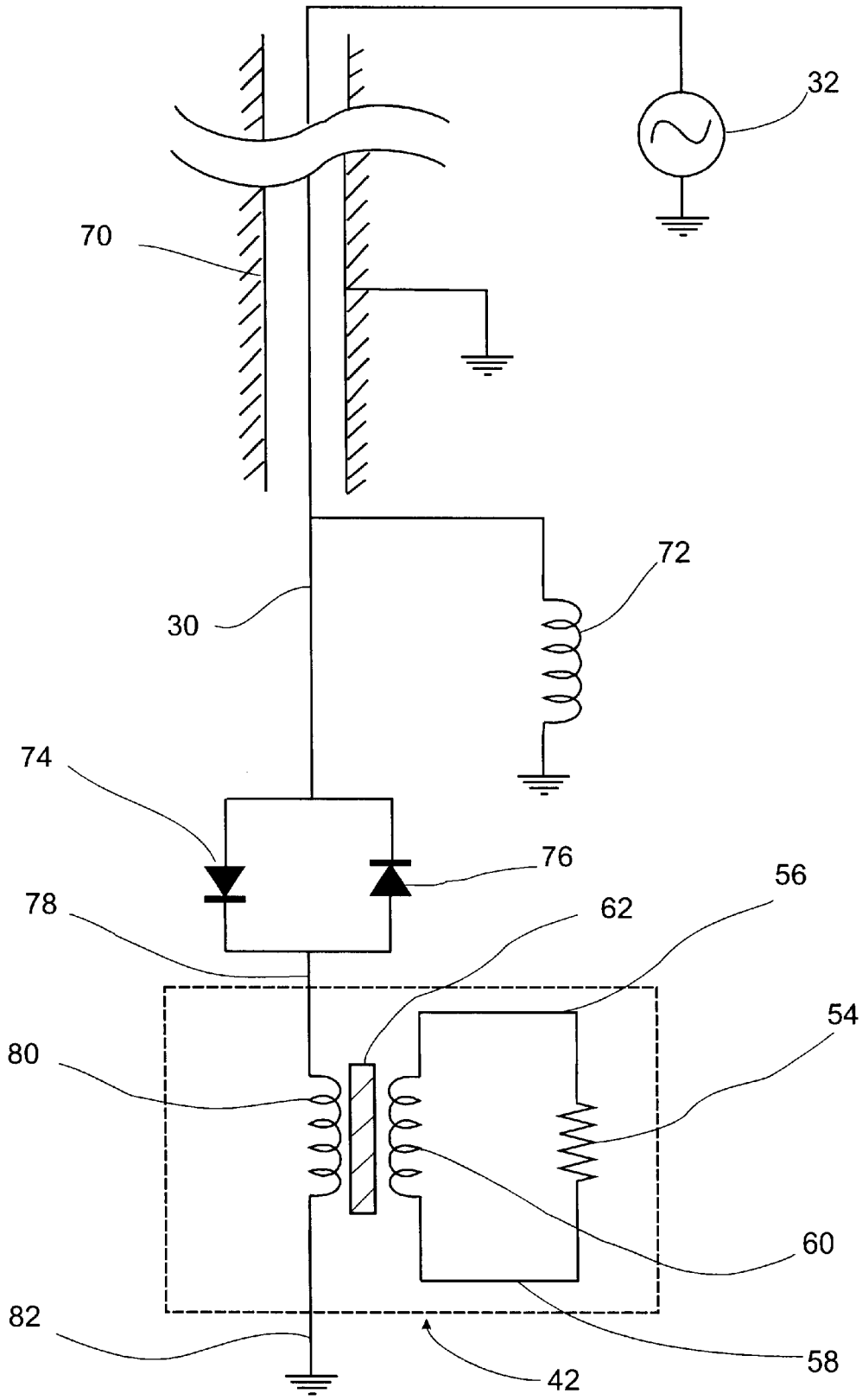
FIG. 2 is an electrical schematic of the detonator of FIG. 1.
Figure 3A:
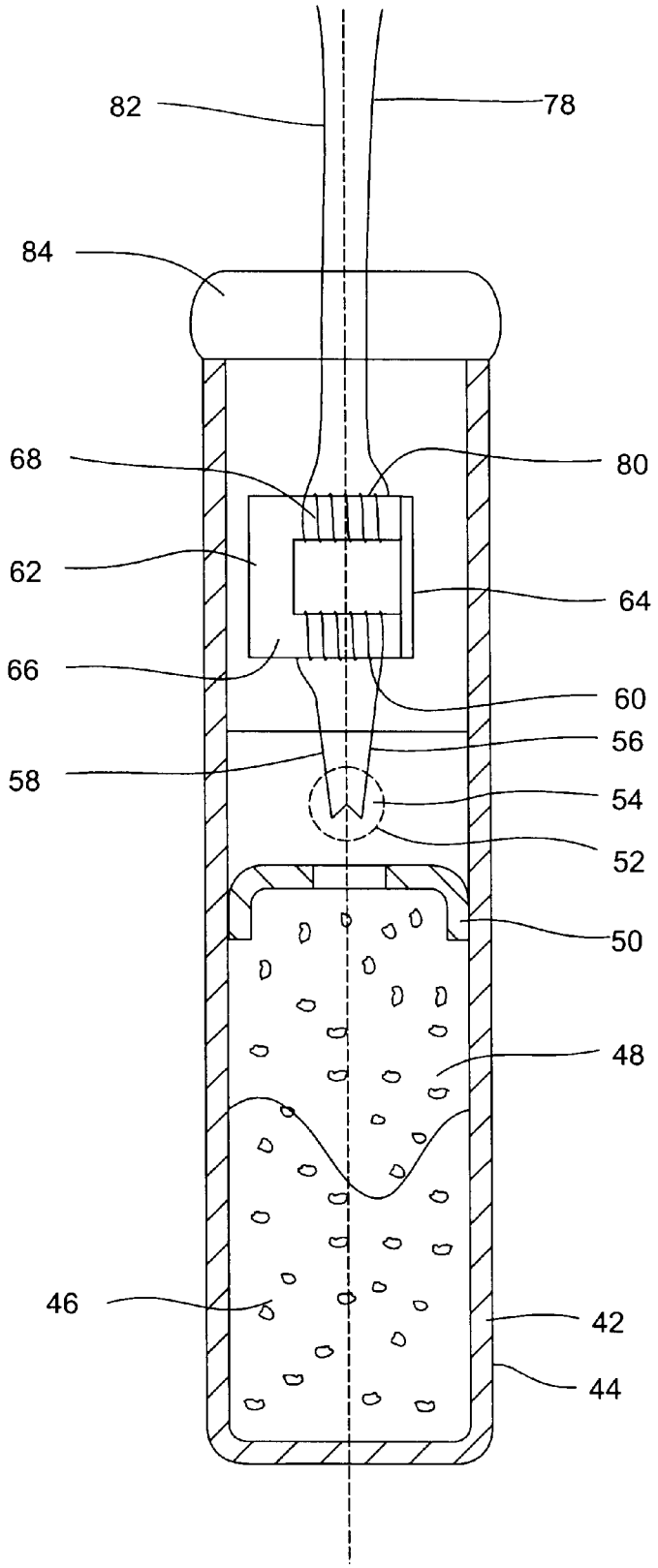
FIG. 3*a* shows a cross section of the detonator of FIG. 1 with a transformer core having a closed magnetic circuit core.

Referring to the electrical representation of FIG. 2 and the physical presentation of FIG. 3*a* in greater detail, detonator 42 has a detonator casing shell 44 with an internal, closed ended, roughly cylindrical chamber 46. Explosive material 48 is packed into the end of chamber 46, and is covered by a partition 50 and pyrotechnic igniter material 52. The igniter material, 52, surrounds an embedded filament in the nature of a bridge wire 54, suspended between the extended ends of two lead wire legs 56 and 58. Legs 56 and 58 are joined in a closed circuit loop by a multiple turn, secondary winding 60 wound about a magnetically permeable, U-shaped Mn—Zn ferrite core 62. A keeper, or closure element 64, again of magnetically permeable material extends between the open legs 66 and 68 of U-shaped core 62 to closed the magnetic circuit of U-shaped core 62.

Referring again to FIGS. 2 and 3*a,* wireline 30 is shielded by a grounded sheathing 70 until it reaches perforating gun assembly 28, and is grounded through collar locator 34. Collar locator 34 has a coil 72 for generating an electromagnetic signal when perforating gun assembly 28 passes junctions in casing 22, so that the exact location of perforating gun assembly 28 in bore 20 can be determined relative to stratum 26. Collar locator coil 72 has an inductance of 11 H, a typical value for such devices. Wireline 30 extends beyond collar locator 34 to a pair of reversed diodes 74 and 76 on parallel paths. One lead wire 78 of a multi-turn primary winding 80 is connected to diodes 74 and 76. Winding 80 is wound about U-shaped core 62, and its remaining lead wire, 82 is grounded. Diodes 74 and 76 are used to permit communication of the firing signal from blasting machine 32 to detonator 42 and to provide high impedance to the small signal generated by collar locator coil 72.

Bridge wire 54 is the part of detonator 42 most sensitive to external stimulation. It forms a closed loop with secondary winding 60. It is physically protected by a cast-in-place plastic plug 84 which serves also to capture and immobilize legs 56 and 58, and bridge wire 54 in igniter material 52. Plug 84 additionally holds diodes 74 and 76; the transformer formed by primary winding 80, secondary winding 60, U-shaped core 62, and closure element 64 in place. Bridge wire 54 is also physically and electro-magnetically protected by shell 44 which is, typically, made of a highly conductive metal such as copper or aluminum. Consequently the loop which includes bridge wire 54 remains electrically neutral as it is electrically shielded by shell 44.

Primary winding 80 and secondary winding 60 are preformed and then assembled on legs 66 and 68 of U-shaped core 62, before being locked in place by nickel alloy closure element 64. This method encourages relatively easy and economical assembly, and contrasts with the method of assembly of threaded-core detonators. Primary and secondary windings 80 and 60 are mounted parallel to each other in an arrangement which reduces the magnetic flux coupled by air and shared by both windings. The number of turns may vary. It is typically in the range of 15 to 80 for primary winding 80 and for secondary winding 60. In the preferred embodiment the number of turns on primary winding 80 is 24, and the number of turns on secondary winding 60 is 12. In the preferred embodiment, the height of core 62 is 8 mm, its thickness is 1.5 mm, and its width is 6 mm.

The number of turns of windings 60 and 80, the permeability of core 62, and the geometry chosen affect the range of frequencies to which detonator 42 is most responsive. Core 62 is chosen so that it responds efficiently to electric currents delivered by specifically designed blasting machine 32, reducing or eliminating electrical hazards. In use, stray DC signals and low frequency AC sources carried on wireline 30 will have little or no effect on bridgewire 54. Since electrical frequencies in a typical well rig environment have frequencies either below 1 kHz (e.g., DC, 50 or 60 Hz AC) or well above 1 Mhz (radio frequency energy in GHz), the probability of unintentional detonation tends to be reduced. When an appropriate firing current is delivered to wireline 30 the current running through primary winding 80 induces a current in the closed circuit loop formed by secondary winding 60, legs 56 and 58, and bridge wire 54. Bridge wire 54 is then heated to incandescence and ignites pyrotechnic igniter material 52. The ignited material 52 initiates detonation of detonator 42, which thereafter sets off the explosive train of cord 40 and shaped charges 38 in perforating gun assembly 28.

The preferred material for core 62 is either a Mn—Zn or an Ni—Zn ferrite chosen to discourage energy transmission at frequencies falling outside the chosen frequency range of blasting machine 32. In the preferred embodiment, the ferrite has an operating range between 3 and 20 kHz, which is too high for general power transmission interference, and too low for interference by radio or communications signals. As noted above, the ferrite chosen must have a Curie temperature higher than the temperature in bore 20 at the level of oil bearing rock stratum 26. Typically a Curie temperature of 200° C. or higher is preferred. In the preferred embodiment the ferrite core chosen has an initial permeability of 2500, a Curie temperature of 230° C., a saturation flux density of 5000 Gauss at room temperature and a field strength of 15 Oersted.

The preferred material for closure element 64 is a super permalloy (T.M.), an alloy of 80% nickel and 20% iron having an A.C. impedance permeability in the order of 100,000 a Curie temperature of roughly 400° C., and a saturation flux density of 8 Gauss. Due to its high permeability, the thickness of closure member 64 is 0.36 mm. The material cost is low, and the alloy can be formed to the shape desired. Closure member 64 in other embodiments, can also be made of a suitable ferrite for a given frequency range or from other magnetic materials, such as silicon steels.

The combination of the material properties of core 62 and closure member 64 provide relatively efficient, and desirable, frequency discrimination. The Mn—Zn ferrite material responds relatively poorly to DC and low frequency AC stimulation, but can operate satisfactorily at higher frequencies as high as a few MHz. By contrast, the magnetic alloy of closure member 64 responds satisfactorily to low frequency AC and DC signals, but tends to attenuate high frequency signals as its permeability decreases with increasing frequency. Also, core losses are approximately proportional to the square of the frequency. Consequently low frequency (<1 KHz) signals are retarded by core 62 and high frequency signals (>1 MHz) are attenuated by closure member 64. When a firing current is delivered by blasting machine 32 to lead wires 78 and 82 both core 62 and closure member 64 are energized, bridge wire 54 is heated to incandescence, and pyrotechnic material 52 is ignited. Thus the combined effect core 62 and closure member 64 is that of a frequency sensitive filter.

Blasting machine 32, located at the far end of wireline 30 from detonator 42, is illustrated in electrical schematic form in FIGS. 5, 6, 7, and 8. It supplies electric current to fire detonator 42 as described at length above. Blasting machine 32 will be described in detail in order of a timing driver, controlling circuit 86, which provides an oscillating signal; a firing circuit indicated generally as 88, in the nature of an inverting circuit which receives the oscillating signal; and a charging circuit indicated generally as 90, which charges energy storage elements of firing circuit 88 to a desired voltage level.

Figure 5:
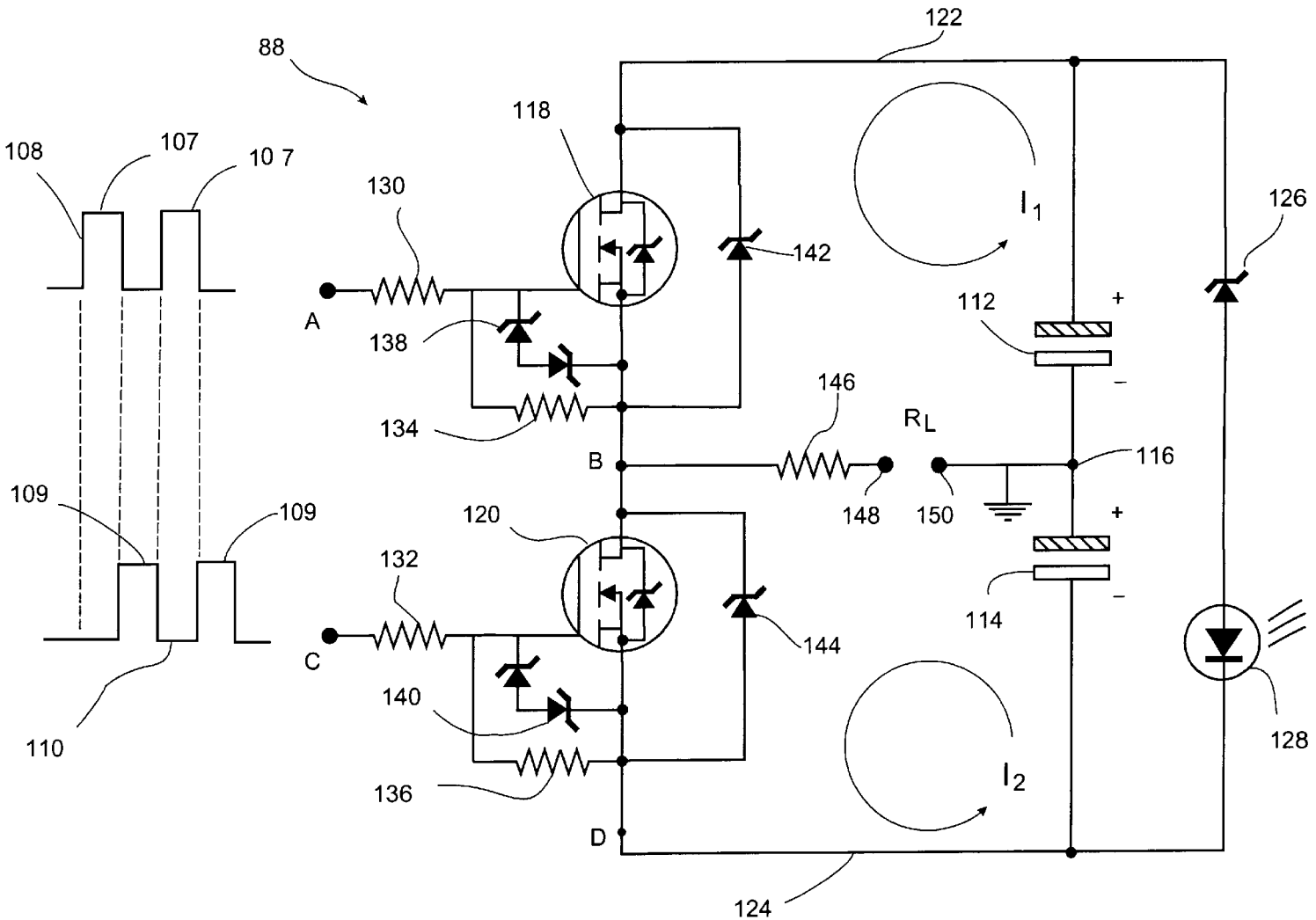
FIG. 5 is an electrical schematic of a half bridge inverter for the blasting machine of FIG. 1.
Figure 6:
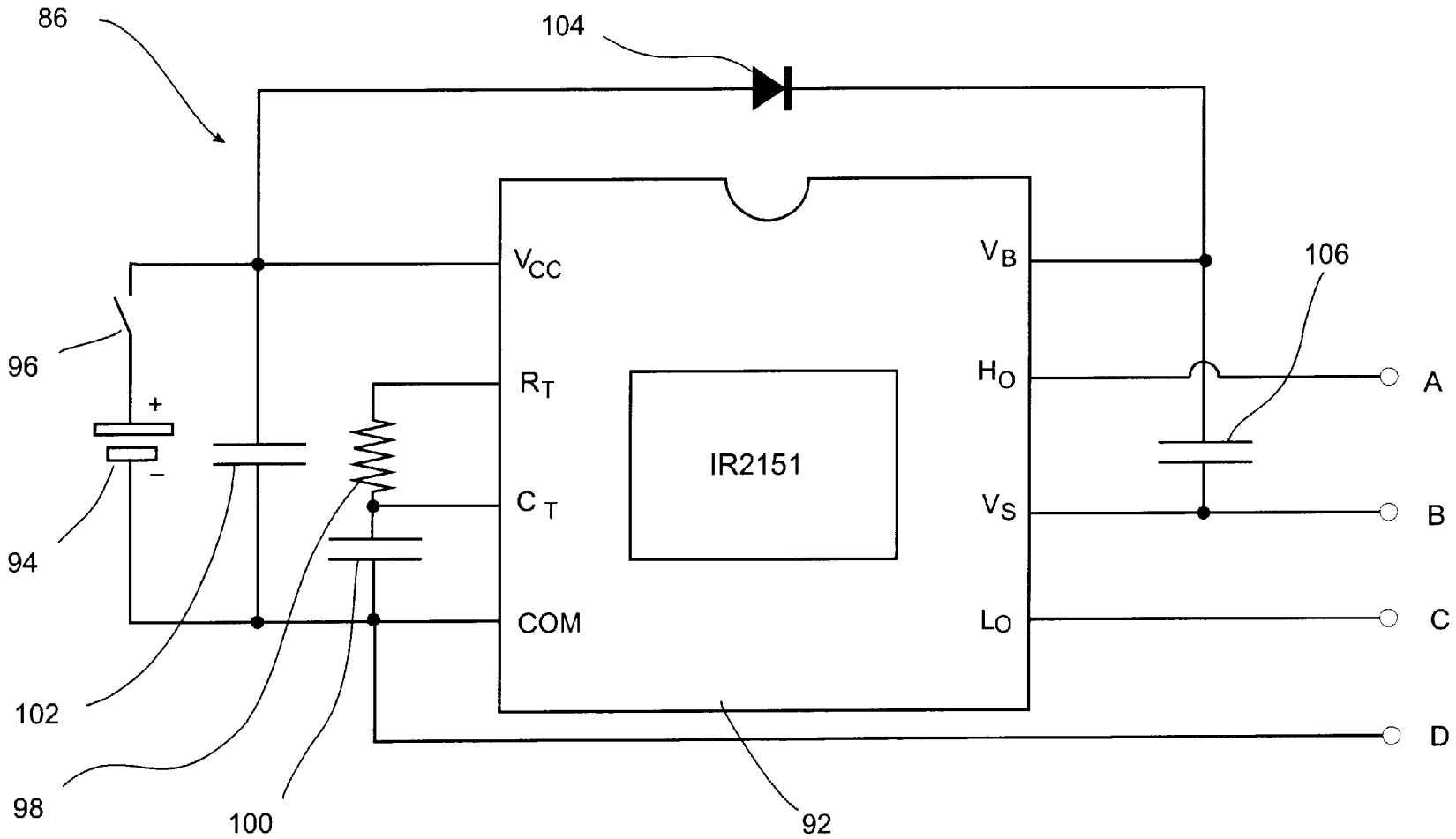
FIG. 6 is an electrical schematic for a self-oscillating driver for the blasting machine of FIG. 1.

The time varying signal generator, or driver, controlling circuit 86, shown in FIG. 6, has as its principle element a commercially available IR2151 self-oscillating MOSFET and IGBT driver chip 92 having $V_{cc}$, $R_t$, $C_t$, Com, $V_b$, $H_o$, $V_s$, and $L_o$ ports. A DC source in the nature of a 15V dry cell 94 has a negative terminal connected to the Com port, and a positive terminal connected, through a switch 96, to $V_{cc}$. A timing resistor 98 is connected across the $R_t$ and $C_t$ ports, and a timing capacitor 100 connected to between the $C_t$ port and an output terminal 'D'. A voltage stabilising capacitor 102 is connected from Com to $V_b$. A diode 104 and capacitor 106 are used to provide high side power supply, high side power supply capacitor 106 being connected across $V_b$ and $V_s$. $V_s$ is connected directly to an output terminal 'B'. $H_o$ and $L_o$ are similarly connected to output terminals 'A' and 'C' respectively. Closure of switch 96 will cause chip 92 to produce a high side, low power square wave output 108 between terminals 'A' and 'B', and an opposite, half period phase shifted low side square wave output 110 between terminals 'B' and 'C', as indicated in FIG. 5. Chip 92 is capable of generating controlling signals over a wide frequency range. In the preferred embodiment, a controlling signal at 12.75 KHz is produced when resistor 98 has a value of 56 Ω, capacitor 100 has a value of 1000 pF and capacitor 106 has a value of 0.47 μF.

Firing circuit 88 is shown in FIG. 5, as a half bridge converter with input ports 'A', 'B', 'C', and 'D' corresponding to output ports 'A', 'B', 'C', and 'D' of driver 86. Back to back energy storage capacitors 112 and 114, whose charging will be described below, are joined in series at a central grounded node 116 and act as power sources for high and low side MOSFETs 118 and 120 respectively, defining a high voltage side 122, and a low voltage side 124. In a preferred embodiment the storage of capacitors 112 and 114 are 470 μF capacitors. MOSFETs 118 and 120 are of the high speed switching type with voltage and current ratings of 1000V and 14 A. A voltage limiting Zener diode 126 and an LED 128 are connected in series between high and low voltage sides 122 and 124 as well. The source of MOSFET 118 and the drain of MOSFET 120 are connected at a common node corresponding to input 'B', with the drain of MOSFET 118 connected to high voltage side 122 and the source of MOSFET 120 connected to low voltage side 124.

The gate of MOSFET 118 is connected to input 'A' across a resistor 130 which, in a preferred embodiment, has a value in the range of 10 to 500Ω. Resistor 130 is used to reduce the quality factor of the input circuit, thereby discouraging parasitic oscillations. Similarly the gate of MOSFET 120 is connected to input port 'C' across a resistor 132 or the same magnitude, for the same purpose.

A gate to source resistor 134 having a value of 1 MΩ is used to reduce resistance from the gate to the source of MOSFET 118. A similar resistor 136 is used with MOSFET 120 for the same purpose. A pair of opposed Zener diodes 138, 140 having a voltage rating of 18V and a power rating of 1 W each are used to protect the gates and sources of MOSFETs 118 and 120. Further Zener diodes 142 and 144 connected between the drains and sources, respectively of MOSFETs 118 and 120 provide protection against voltage surges. Higher voltage protection could be obtained by connecting more than one such Zener diode in series.

Finally, a 30Ω current limiting resistor 146 extends from input port 'B' to a first load terminal 148, while a second load terminal 150 is connected directly to central grounded node 116. The current initiating resistor is 30Ω in the preferred embodiment.

Figure 7:
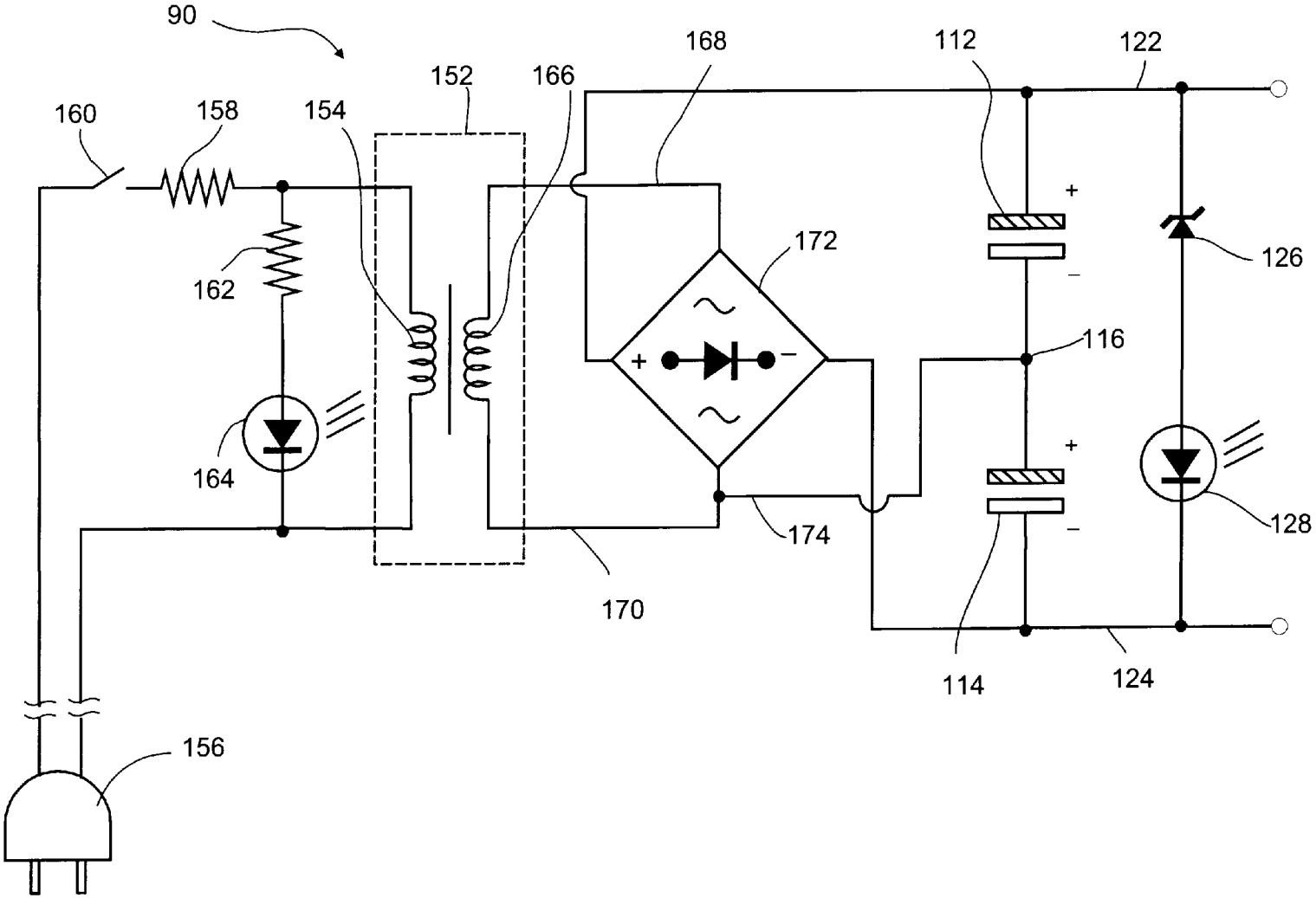
FIG. 7 is an electrical schematic for a charging system for the blasting machine of FIG. 1.

A third component of blasting machine 32 is charging circuit 90. As shown in FIG. 7, it has a small step up transformer 152 has a primary coil 154. Primary coil 154 has one lead connected to a standard, single phase, 115V, 60 Hz AC plug 156, and has another lead, connected through a current limiting resistor 158 and through a switch 160 to connect with the other side of plug 166. A current limiting resister 162 and LED 164 in series are connected in parallel with primary coil 154 to indicate the working conditions of the transformer.

Secondary coil 166 of transformer 152 has leads 168, 170 connected to opposite sides of a full wave bridge rectifier 172. The positive output of rectifier 172 is connected to high voltage side 122 and the negative side of rectifier 172 to low voltage side 124 of blasting machine 32. One of leads 168 or 170 is connected by a jumper 174 to grounded node 116, for the purpose of doubling the voltage level of main capacitors 112 and 114.

In operation, assuming that power storage capacitors 112 and 114 are initially uncharged, charging circuit 90 is plugged in to a suitable source, wireline 30 is disconnected from output load terminals 148 and 150, and timing circuit switch 96 is open. Charging circuit switch 160 is then closed to charge capacitors 112 and 114. Once capacitors 112 and 114 have been charged to 300V, switch 160 may be opened or the power source may be disconnected.

After perforating gun assembly 28 has been conveyed along bore 20 to an appropriate position amidst oil bearing rock stratum 26, wireline 30, and hence, ultimately primary winding 80, is connected to load terminal 148. Load terminal 150 is grounded through node 116 and primary winding 80 being connected to ground 82. When timing signal switch 96 is closed, square wave signals 108 and 110 will be sensed at the respective gates of MOSFETs 118 and 120, turning them on and off alternatively and giving a peak output current in the range of 1 to 12 A. When a positive voltage of 10 to 15V is applied to terminals A and B (that is, gate to source), MOSFET 118 conducts, capacitor 112 discharges through it and a current runs through current limiting resistor 146 to the load, that is, wireline 30 and the components of detonator 42, forming a first half cycle of electric current shown as $I_1$ as shown in FIG. 5. In the second half of a cycle, MOSFET 120 conducts and MOSFET 118 is switched off. Capacitor 114 discharges to the load, $R_L$, that is, through detonator 42 and current limiting resistor 146 such that an electric current indicated as $I_2$ in the lower side. In this manner the two (2) MOSFETs 118 and 120 will conduct alternately, yielding an alternating current in load $R_L$ until both capacitors 112 and 114 are discharged. The alternating current produced in this manner is carried along wireline 30 to primary winding 80 to induce a current in secondary winding 60, and bridgewire 54, which in turn heats to incandescence and sets off igniter material 52. In the preferred embodiment, blasting machine 32 constructed using the circuitry described herein has a maximum peak to peak current output of 16A or a maximum peak to peak voltage output of 900V, assuming capacitors 112 and 114 have been charged to 450V each, and resistor 146 has a value of 55Ω. In use the embodiment described yields a signal having relatively high voltage, relatively large current, relatively high momentary power output, and relatively short duration.

The apparatus described has been found to discourage unintentional firing due to stray currents from common AC or DC sources, radio frequency energy, lightning and other electrostatic discharges. The inventors have found that it discourages firing, even when commonly used electric sources are applied directly to leadwires 78 and 82 (with the DC firing current of the material 52 of 0.8 A). The inventors have found that detonators made according to the above description have resisted firing when exposed to 115V, 60 Hz AC; 220V, 50 Hz AC; 380V, 50 Hz AC; and when connected to a 705 $\mu$F capacitor charged to 600V.

Having described the preferred embodiment of the invention, it should be noted that a number of alternatives are possible without departing from the principles or spirit of the invention. The detonator of the present invention can be manufactured in different forms to facilitate its use. For example, a block detonator is a design that provides some space between the detonator and detonating cord by using a block, allowing fluid desensitization. A top fire detonator is designed to start a top-down detonation of the explosive train in the gun. A detonator in capsule version is directly exposed to the high pressure in the well. The present detonator may be manufactured in any of these forms.

Figure 3B:
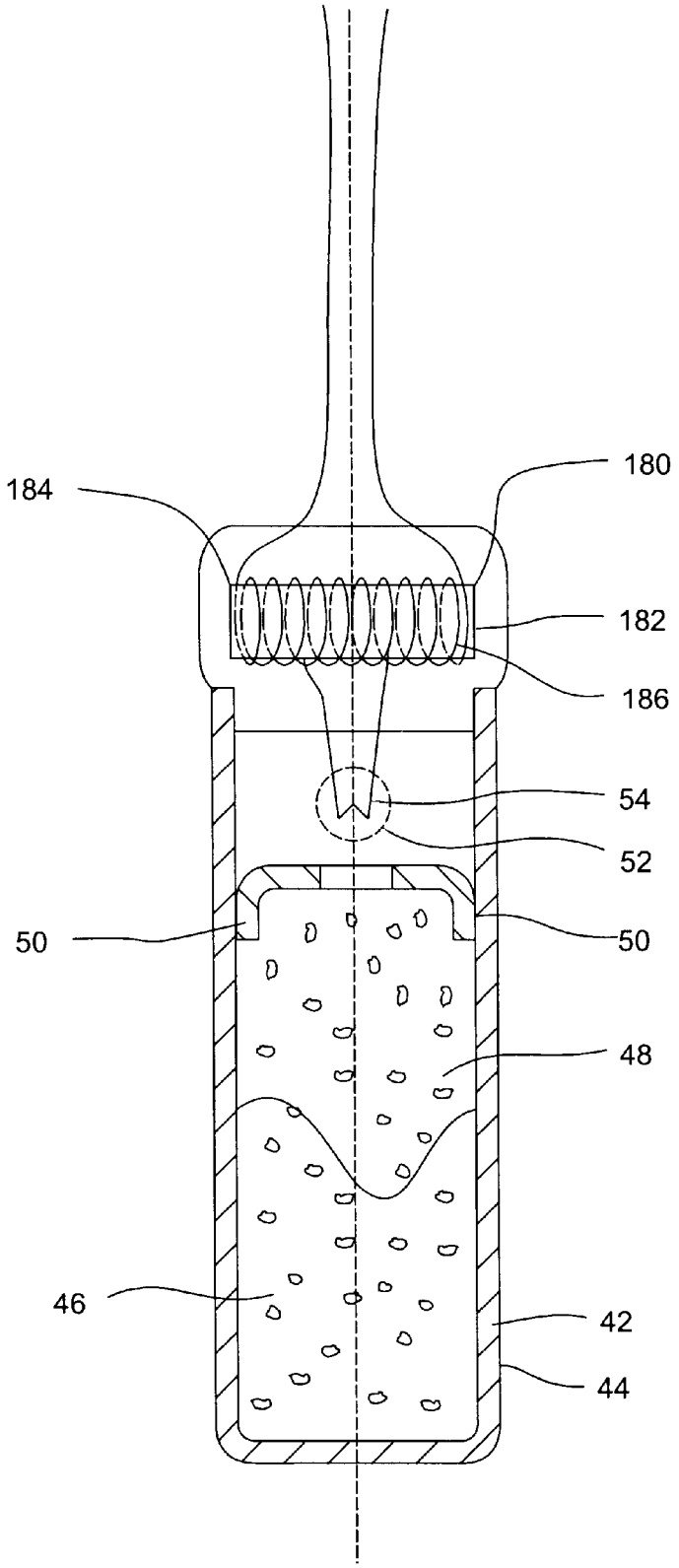
FIG. 3*b* shows a cross section of an alternative detonator to the detonator of FIG. 1 with a transformer core not having a closed magnetic circuit transformer core.

Four alternative versions of detonator geometry are shown in FIGS. 3*b,* 4*b,* 4*c* and 4*d.* FIGS. 3*b* shows a transversely mounted detonator transformer 180 having a circular cylindrical ferrite core 182 of a diameter of a 5 mm and a length of 6 mm. A primary winding 184 having 60 turns and a secondary winding 186 of 30 turns are wound in a nested, co-axial fashion about core 182, that is to say, one winding is embedded within the other. Ferrite core 182 is a simple ferrite bar, and, as shown, is an open magnetic circuit. The magnetic properties of the bar are the same as those of U-shaped core 62 of the preferred embodiment of FIG. 3*a.*

Figure 4A:
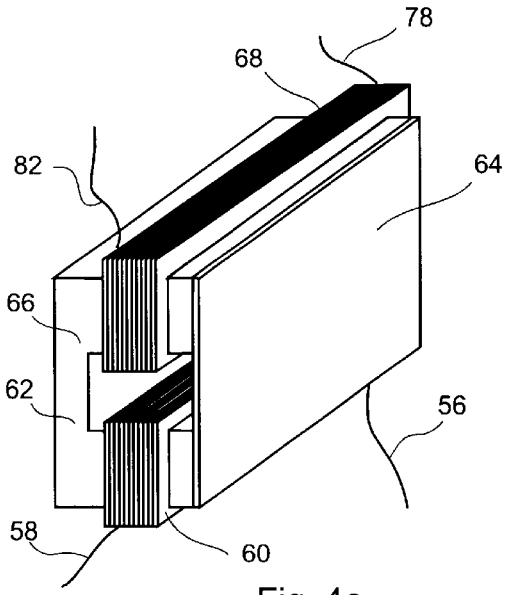
FIG. 4*a* shows a general view of the transformer of FIG. 3*a*.
Figure 4B:
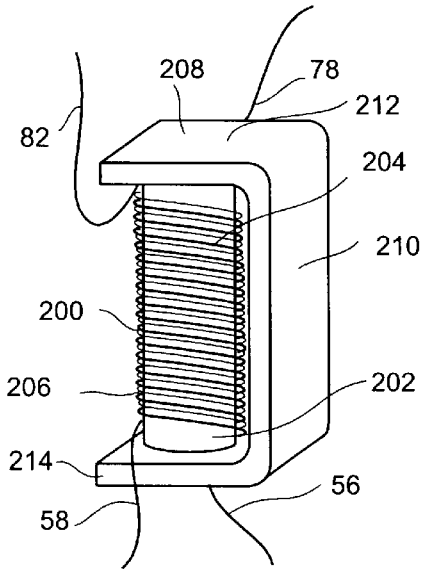
FIG. 4*b* shows an alternative closed loop transformer for the detonator of FIG. 1.

FIG. 4*b* shows a detonator transformer 200 having a circular cylindrical ferrite core 202, 6 mm long and 5 mm in diameter, about which a primary winding 204 having 60 turns, and a secondary winding 206 having 30 turns are coaxially wound in a nested fashion. Core 202 is then held about its ends by a U-shaped, or half rectangle shaped, magnetic alloy closure member 208 having a back 210 and legs 212 and 214. Closure member 208 could also be in the form of a full closed rectangle, or a circle or other shape making a closed loop for capturing core 202 about its ends.

Alternatively, the transformer core could be in the form of a bobbin or spindle having at one end a radially extending flanged base or shoulder, with a closure member in the shape of a cap, or thimble, at least partially covering the spindle with continuous magnetically permeable structure extending from one end of the spindle to the other. The foregoing alternatives are only examples of cores that could be used in the present invention, other configurations such as a plate, a square column, or a square or round tube, and other configurations also being possible.

Figure 4C:
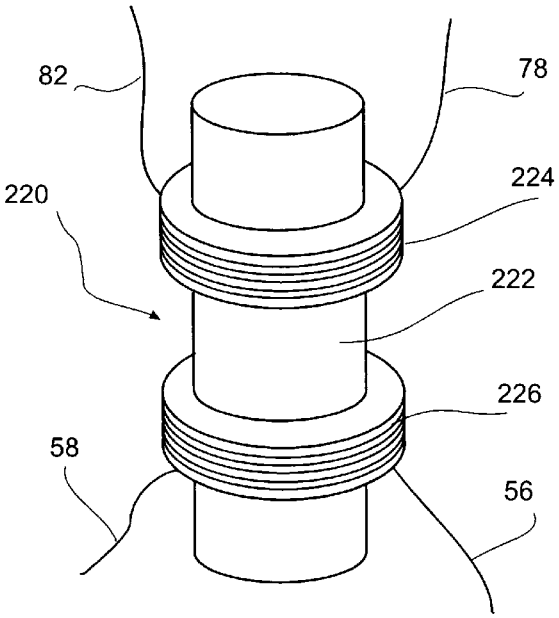
FIG. 4*c* shows an alternative transformer geometry for the detonator of FIG. 1.

FIG. 4*c* shows a detonator transformer 220 having a circular cylindrical ferrite core 222 of a diameter of a 5 mm and a length of 6 mm. A primary winding 224 having 60 turns is wound about one portion of core 222. A secondary winding 226 of 30 turns is wound about another portion of core 222. There is no highly magnetically permeable closure member, rather the magnetic circuit of ferrite core 222 is left open.

Figure 4D:
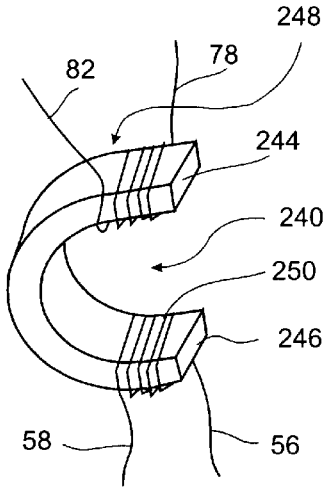
FIG. 4*d* shows a further alternative geometry for an open loop transformer for the detonator of FIG. 1.

FIG. 4*d* shows a detonator transformer 240 having a core 242 in the form of a C-shaped half cylinder section, much like a half toroid but with a rectangular cross section, having toes 244 246. A primary winding 248 of 60 turns is wound about toe 244 and a secondary winding 250 of 30 turns is wound about toe 244. As before, there is no highly magnetically permeable closure member spaning the gap between toes 244 and 246 to form a closed loop path.

It will be appreciated that the geometry of the transformer core may vary, and it may be in the form of an open core, or a core having a closure member and a closed loop magnetic path. The core may be solid, or it may be a hollow tube, whether of circular, square, or other section.

The relative position of the primary and secondary windings has an effect on output performance. When one winding is embedded within the other, or the two windings are coaxial and close together or abutting, it is possible for a low or non-magnetically permeable material, whether air, a ceramic, paper or plastic core, to couple sufficient magnetic flux between the two windings to permit detonation. For example, a sudden fluctuation in a 150 A current can be enough to trigger detonation. If the axes of the windings are parallel and spaced apart an axial distance, similar to the axial distance shown in FIG. 3*a,* the magnetic flux coupled by air between the two cores is reduced, or minimized.

In all cases, the detonator transformer windings present a significant level of impedance to the firing current supplied by blasting machine 32 and coupled by wireline 30. This is done by using a relatively large number of turns on both the primary and secondary windings, rather more than merely one or two turns. The minimum number of turns has not been determined, but is thought to be at least five. Hand threading multi-turn cores is generally impractical, more so in oil well detonators since a typical inside diameter for a casing, like shell 40, is 6 mm, implying very small core and winding sizes. It is more economical to form these multi-turn windings by machine, and this is facilitated if, at the time of manufacture, the core presents an open ended spindle, or mandrel, upon which a winding can be wound, or upon which a pre-formed winding can be slipped. The winding, or windings, can then be retained in place either by the mechanical tightness of the winding, an adhesive, or by mechanical means such as a fastener, a bent over flange, or, as in FIGS. 4*a* and 4*b,* by a magnetically permeable closure member. The spindle, or mandrel, portion, or portions of the core, may be circular in section, as in the case of FIGS. 4*b* and 4*c,* or rectangular, as in the case or FIGS. 4*a* and 4*d,* or some other shape or shape as may be found convenient.

Figure 8:
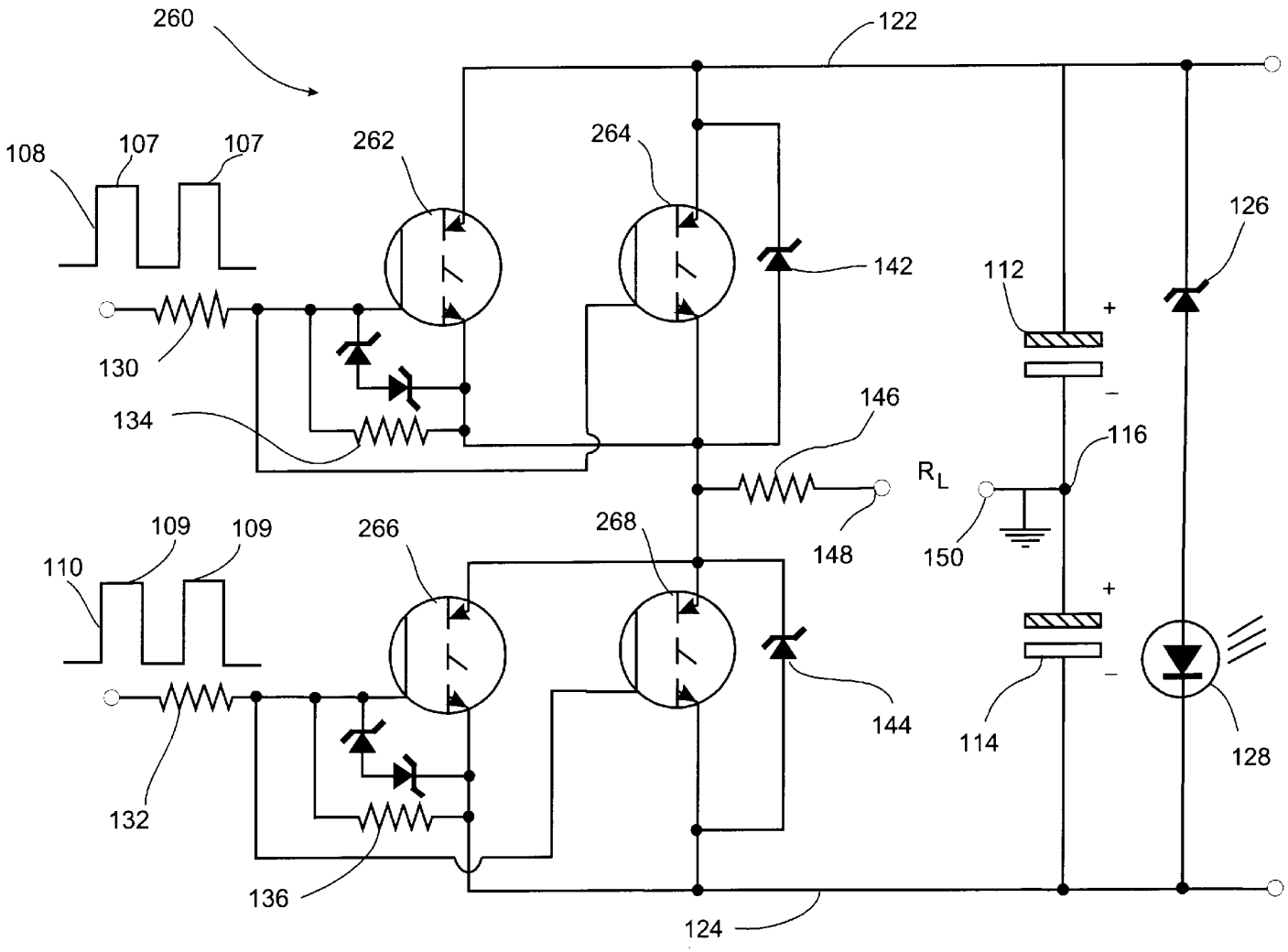
FIG. 8 is an electrical schematic an alternative half bridge inverter for the blasting machine of FIG. 1

The alternative blasting machine 260 of FIG. 8 shows a half bridge structure of an inverting circuit using pairs of two IGBTs 262, 264 or 266, 268 in parallel in place of MOSFETs 118 or 120, for the purpose of increasing the maximum current out put of the blasting machine.

Figure 9:
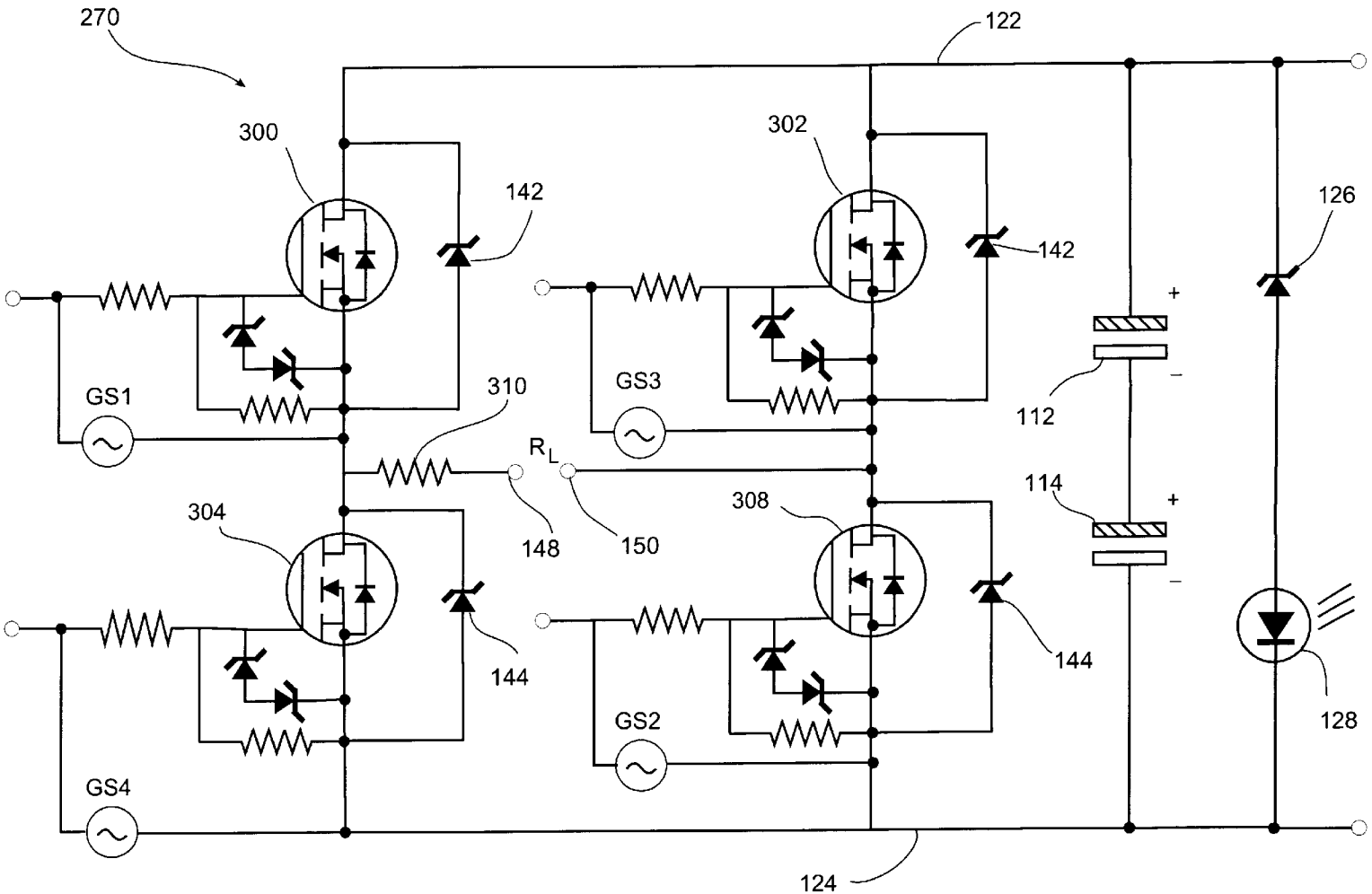
FIG. 9 is an alternative electrical schematic for a full bridge inverter for the blasting machine of FIG. 1.
Figure 10:
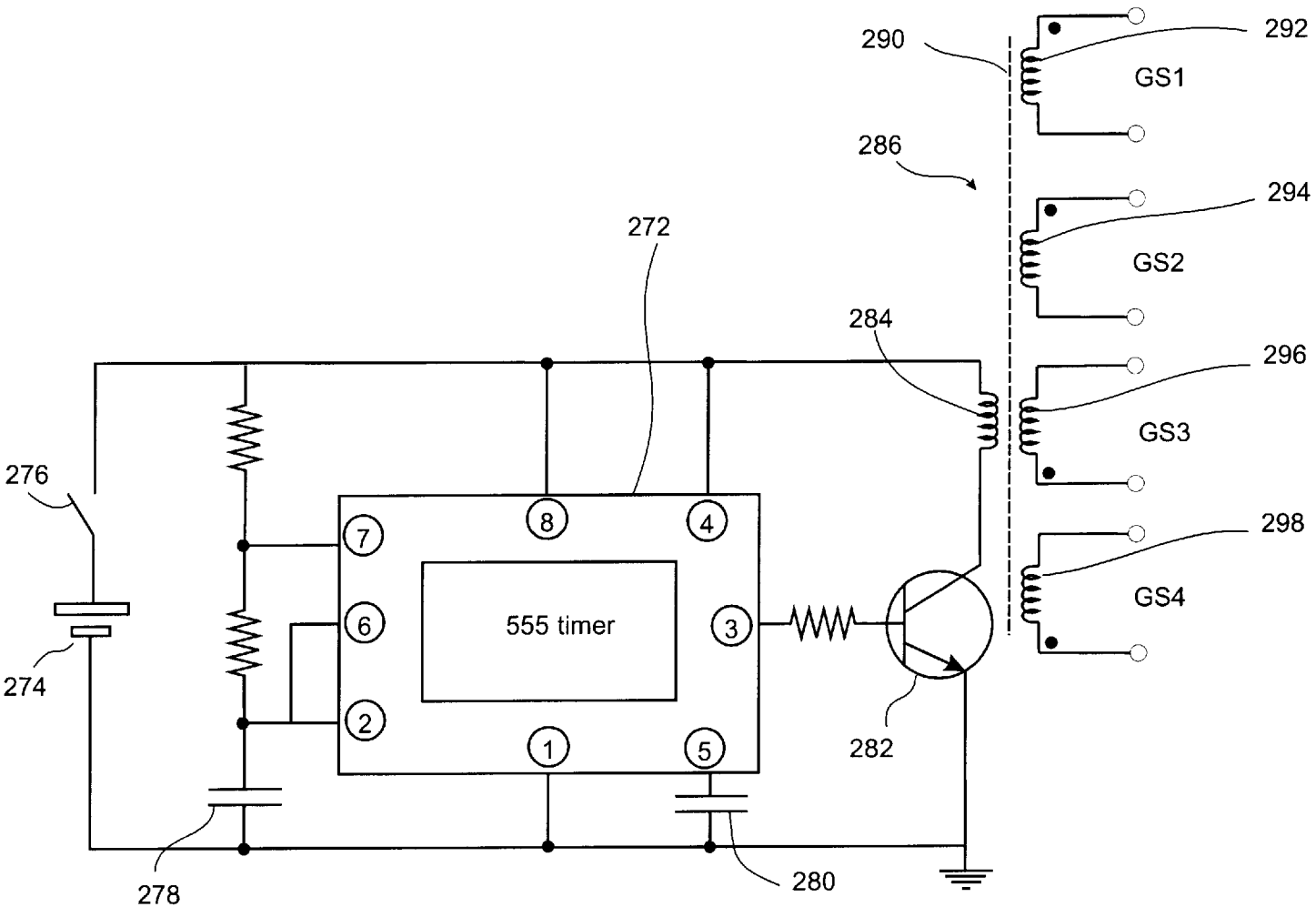
FIG. 10 is a timer circuit schematic for the full bridge inverter of FIG. 9.

The full bridge 270 of FIG. 9 is for use when a higher voltage output is required than can be produced with the similar half bridge of FIG. 5. Those elements that are unchanged from FIG. 5 are indicated by the same item numbers as above. A circuit as shown in FIG. 10 can be used to drive full bridge 270 of FIG. 9. It uses a 555 timer 272 as a square wave signal generator. The circuit is powered by battery 274 controlled by a switch 276. The frequency of the signal is determined by the values of the capacitors 278 and 280. The output signal of timer 272 is amplified using transistor 282 whose collector is connected to the primary winding 284 of a small transformer 286. The transformer is coupled with a ferrite core 290 and has four identical secondary windings 292, 294, 296 and 298 with the polarity shown, at which output signals identified as GS1, GS2, GS3, and GS4 are sensed.

Referring again to FIG. 9, full bridge 270 has four MOSFETs 300, 302, 304, and 306 arranged to work in diagonal pairs to produce a doubled-voltage push-pull effect. MOSFETs 300 and 306 are driven by signals GS1 and GS2, of the same polarity, MOSFETs 302 and 304 are driven by signals GS3 and GS4, of the opposite polarity. MOSFETs 300 and 306 conduct simultaneously as a pair, and alternate with the other pair formed by MOSFETs 302 and 304. The net result, as before, is to drive an alternating current through a current limiting resistor 310 and the load, $R_L$. In the embodiment shown, each MOSFET 300, 302, 304 and 306 has a voltage and current rating of 1000V and 14 amperes, respectively. As before, capacitors 112 and 114 have a capacitance of 470 micro F each, in the preferred embodiment. They are connected in series and charged to 800V. The value of current limiting resistor 310 is 80 ohms.

Full bridge 270 of FIG. 9 is driven by 555 timer 272 of FIG. 10 at a frequency of 20 KHz. Consequently, a blasting machine constructed using this circuitry has a maximum peak to peak current of 20 A, or a maximum peak to peak voltage of 1600V. Controlling circuit of FIG. 10 is one example of a controlling circuit suitable for use with a full wave inverter. Other electronic circuits could be used as well.

Although only two types of power transistors, i.e., MOSFETs and IGBTs, are used in the description of the present invention, other types of power transistors can also be used. Bipolar transistors, Giant Darlington power transistors, and gate turn-off silicon-controlled rectifiers can be used in place of MOSFETs and IGBTs with corresponding changes in the driving circuits according to their driving requirements.

In the description of the present invention, the circuits are shown in discrete elements. However, it is understood that the half bridge or full bridge converter can be integrated into a single chip along with its driving circuit, making it more compact and less expensive.

In each embodiment described, the blasting machine does not require an output transformer. However, it does not exclude the use of a transformer for other purposes, such as for isolation of electronic circuits, or for impedance matching between the blasting machine and the load. In such uses, the transformer is not involved in the conversion of the DC currents to high frequency AC currents. The transformer is not a necessary part of the converter.

In addition to charging circuit 90 shown in FIG. 7, capacitors 112 and 114 can be charged using dry batteries, an oscillating circuit, a step up blasting machine or other suitable circuit. The use of commercially available single phase 11V, 60 Hz AC, as shown in FIG. 7, corresponds to a source commonly available from truck mounted generators at well sites.

Although developed mainly for oil well casing perforation, the apparatus of the present invention can also be used in other oil field applications such as exploration, pipe cutting, severing, and so on. Furthermore, the apparatus of the present invention can also be used to replace conventional bridge wire detonators in mining, construction and other engineering projects where the initiation of explosives is involved.

This description is made with reference to the preferred embodiment of the invention. However, it is possible to make other embodiments that employ the principles of the invention and that fall within its spirit and scope as defined by the following claims.

We claim:

1. A blasting machine for producing an electrical multi-pulse detonation signal for setting off a signal selective detonator, comprising:

a charge storage system including a capacitor;

an output port from which the multi-pulse detonation signal can be sent to the signal selective detonator;

a switching system including a semi-conductor switch connected between said capacitor and said output port, said semi-conductor switch being operable to control current flow between said capacitor and said output port; and a discharge control system including a wave generator connected to said semi-conductor switch, said wave generator being operable to cause said semi-conductor switch repeatedly to conduct and to interrupt discharge of current from said capacitor through said output port to produce the multi-pulse detonation signal.

2. The blasting machine of claim 1, further comprising a charging system selectively connectable to the charge storage system when the discharge control system is inoperative.

3. The blasting machine of claim 2, wherein the charging system includes a transformer connectable to draw power from a standard line source, and a rectifier connected to the transformer for converting the power to a form storable in the charge storage system.

4. The blasting machine of claim 3, wherein the wave generator of the discharge control system includes a timer for producing at least one square wave output signal at a pre-set frequency for operating said semi-conductor switch.

5. The blasting machine of claim 4, wherein the wave generator of the discharge control system includes a timer operable to produce a pair of square wave signals offset by a 180 degree phase shift for operating said semi-conductor switch.

6. The blasting machine of claim 1, wherein the charge storage system comprises a pair of opposed capacitors connected to be alternately discharged through the switching system.

7. The blasting machine of claim 1, wherein:

said capacitor is a first capacitor;

the charge storage system includes a second capacitor;

said first and second capacitors define a pair of opposed capacitors connected for alternate discharge through the switching system;

said semi-conductor switch is a first semi-conductor switch;

the switching system includes a second semi-conductor switch;

said first and second semi-conductor switches are each operable to control current flow between one of said capacitors and said output port; and the discharge control system is operable to activate the switches alternately.

8. The blasting machine of claim 1 wherein:

charge storage system comprises a pair of opposed capacitors connected for alternate discharge through the switching system;

the switching system comprises two alternatively selectable pairs of semi-conductor switches, one member of each pair for controlling discharge from each of the capacitors in a push-pull configuration; and the discharge control system has output means for controlling operation of the two pairs of switches.

9. The blasting machine of claim 1 wherein:

said capacitor is a first capacitor;

the charge storage system includes a second capacitor connected in opposition to said first capacitor;

said semi-conductor switch is a first semi-conductor switch;

said switching system includes second, third and fourth semi-conductor switches;

said first and second semi-conductor switches define a first pair of switches;

said third and fourth switches define a second pair of switches;

the first and second pairs of switches are connected to control discharge from said first and second capacitors in a push-pull configuration; and the discharge control system is operable to control operation of the two pairs of switches.

10. The blasting machine of claim 1 wherein:

said output port has a first terminal and a second terminal, said second terminal being connected to ground;

said capacitor is a first capacitor;

said charge storage system includes a second capacitor;

said first capacitor and said second capacitor each have a connection to ground;

said first capacitor is chargeable to a positive voltage relative to ground, and said second capacitor is chargeable to a negative voltage relative to ground;

said discharge control system includes a signal generator operable to generate a first wave train and a second wave train;

said first wave train has a frequency in the range of 3 kHz to 20 kHz;

said second wave train has the same frequency as said first wave train and is 180 degrees out of phase relative to said first wave train;

said semi-conductor switch is a first semi-conductor switch;

said switching system includes a second semi-conductor switch;

said first semi-conductor switch has a collector connected electrically to said first capacitor, a drain connected to permit current flow between said collector of said first semi-conductor switch and said first terminal of said output port, and a gate connected to receive said first wave train from said discharge control system;

said second semi-conductor switch has a collector connected to permit current to flow between said collector of said second semi-conductor switch and said first terminal of said output port, a drain connected to said second capacitor, and a gate connected to receive said second wave train from said discharge control system;

whereby operation of said signal generator controls said first and second semi-conductor switches to alternately discharge said first and second capacitors through said output port when said output port is connected to a load.

11. A combination, comprising:

a signal selective detonator for receiving a detonation signal;

a blasting machine operable to send an electrical multi-pulse detonation signal to the signal selective detonator, the blasting machine having a charge storage system including a capacitor for storing and discharging an electric charge;

an output port from which the multi-pulse detonation signal can be sent to the signal selective detonator;

a switching system including a semi-conductor switch connected between the capacitor and the output port, said semi-conductor switch being operable to control current flow between said capacitor and said output port;

a discharge control system including a multi-pulse wave generator connected to said semi-conductor switch, said wave generator being operable to cause said semi-conductor switch to conduct and to interrupt discharge current of said capacitor through said output port repeatedly to produce the multi-pulse detonation signal;

the signal selective detonator having a transformer having first and second multi-turn coils linked by a magnetically permeable core;

at least one of the first and second multi-turn coils being a pre-formed coil mounted on the core, said first coil being connectable to receive the multi-pulse signal from the blasting machine;

an explosive igniting element connected to said second multi-turn coil to form a neutral closed loop circuit;

explosive material in contact with the explosive igniting element; and when said blasting machine and said detonator are electrically connected in a circuit, said transformer being operable to pass an electric current through said explosive igniting element to ignite said explosive material when said multi-pulse time varying detonation signal is received from said blasting machine.

12. The combination of claim 11 wherein said wave generator is operable to produce a wave having a frequency in the range of 3 kHz to 20 kHz.

13. The combination of claim 11, further comprising a signal carrier having a first end connected to the blasting machine, and a second end connected to the detonator.

14. The combination of claim 13 wherein said signal carrier is greater than 1000 m long.

15. The combination of claim 11 wherein each of said first and second coils has at least five turns.

16. The combination of claim 11 wherein said magnetic core provides a magnetic flux path to carry the same magnetic flux through said first coil as through said second coil.

17. The combination of claim 11 wherein:

said core of said transformer includes a first portion and a second portion joined together in a magnetic path;

said first portion of said core is a first material for attenuating electrical signals in a first range of frequencies;

said second portion of said core is made of a second material for attenuating electrical signals in a second range of frequencies; and said multi-pulse signal has a frequency lying between said first and second ranges of frequencies.

18. The combination of claim 17 wherein said first range of frequencies is below 3 kHz, and said second range of frequencies is above 20 kHz.

19. The combination of claim 18 wherein said first and second portions of said core are joined together to form a closed loop, high permeability magnetic path.

20. The combination of claim 18 wherein:

one of said first and second portions is U-shaped, having first and second legs;

said first coil is a pre-formed coil mounted to said first leg;

said second coil is a pre-formed coil mounted to said second leg; and the other of said first and second portions of said core is a keeper mounted across said U-shaped portion to form a closed loop.

21. The combination of claim 11 wherein said transformer, said explosive igniting element and said explosive material are potted within, and shielded by, an electrically conductive shell.

22. The combination of claim 11 wherein said core has a Curie temperature of greater than 150 C.

23. The assembly of claim 18 wherein one of said first and second portions of said core is made of a ferrite, and the other of said first and second portions is made of a nickel alloy.

24. The detonator of claim 11 wherein:

said transformer is operable to pass the same magnetic flux through said first and second coils;

said first coil has between 15 and 80 turns;

said second coil has at least five turns; and said second coil has fewer turns than said first coil.

25. The combination of claim 11 wherein:

said core includes a U-shaped magnetically permeable member made of a first magnetically permeable material and having a back and a pair of legs, each of said legs having a free end distant from said back;

said first coil is a pre-formed coil and said second coil is a pre-formed coil;

said detonator includes a magnetically permeable closure member connected between said free ends of said legs to lock said first and second coils thereto and to form a continuous magnetic circuit with said U-shaped magnetically permeable member, said closure member being made of a second magnetically permeable material different from said first magnetically permeable material;

said first magnetically permeable material being chosen to attenuate alternating current signals in a first frequency range;

said second magnetically permeable material being chosen to attenuate alternating current signals in a second frequency range separated from said first frequency range; and said detonator being operable in a frequency band between said first and second frequency ranges.

26. A detonator as claimed in claim 11 wherein:

said first coil, said second coil, and said core are potted in a plastic plug, said first coil having legwires extending outwardly of said plastic plug for connection to the detonation signal collector;

said detonator has a protective shell mated to said plastic plug; and said second coil, said explosive igniting element, said explosive material are contained within said protective shell.

27. A blasting machine for producing an electrical multi-pulse detonation signal for setting off a signal selective detonator, comprising:

a charge storage system including a capacitor;

an output port from which the multi-pulse detonation signal can be sent to the signal selective detonator;

a switching system including a semi-conductor switch connected between said capacitor and said output port to control discharge from said capacitor through said output port;

said semi-conductor switch having a first state and a second state, in said first state said semi-conductor switch permitting discharge of said electric charge from said capacitor through said output port, and in said second state said semi-conductor switch impeding discharge of said electric charge from said capacitor through said output port; and a discharge control system including a wave generator operable to cause said semi-conductor switch to alternate between said first and said second states to produce the multi-pulse detonation signal at said output port.

28. The blasting machine of claim 27, wherein the wave generator of the discharge control system includes a timer operable to produce at least one square wave output signal at a pre-set frequency.

29. The blasting machine of claim 27, wherein the wave generator of the discharge control system includes a timer operable to produce a pair of first and second square wave signals offset from one another by a 180 degree phase shift.

30. A blasting machine for producing an electrical multi-pulse detonation signal for setting off a signal selective detonator, comprising:

a charge storage system including a capacitor for storing and discharging an electric charge;

an output port from which the multi-pulse detonation signal can be sent to the signal selective detonator;

a switching system including a semi-conductor switch connected between said capacitor and said output port, said semi-conductor switch being operable to vary discharge from said capacitor; and a discharge control system including a wave generator connected to said semi-conductor switch, said wave generator being operable to cause said semi-conductor switch to vary discharge of said electric charge from said capacitor through said output port to produce the multi-pulse detonation signal.

31. The blasting machine of claim 30, further comprising a charging system selectively connectable to the charge storage system when the discharge control system is inoperative.

32. The blasting machine of claim 30, wherein the charge storage system comprises a pair of opposed capacitors connected to be alternately discharged through the switching system.

33. The blasting machine of claim 30, wherein:

said capacitor is a first capacitor;

the charge storage system includes a second capacitor;

said first and second capacitors define a pair of opposed capacitors connected for alternative discharge through the switching system;

said semi-conductor switch is a first semi-conductor switch;

the switching system includes a second semi-conductor switch;

said first and second semi-conductor switches are operable to vary discharge from one of said capacitors and said output port; and the discharge control system is operable to activate the switches alternately.

34. A process for producing an electrical multi-pulse detonation signal sent from a blasting machine for setting off a signal selective detonator, said blasting machine having a charge storage system including a capacitor for storing an electric charge, an output port from which the multi-pulse detonation signal can be sent to the signal selective detonator, a switching system including a semi-conductor switch connected between said capacitor and said output port to control discharge from said capacitor through said output port, said semi-conductor switch having a first state and a second state, in said first state said semi-conductor switch permitting discharge of said electric charge from said capacitor through said output port, and in said second state said semi-conductor switch impeding discharge of said electric charge from said capacitor through said output port, and a discharge control system including a wave generator operable to cause said semi-conductor switch to alternate between said first and said second states to produce the multi-pulse detonation signal at said output port, and a charging system selectively connectable to the charge storage system when the discharge control system is inoperative;

the process including the steps of:

(a) storing the electric charge in the capacitor; and (b) operating said wave generator to cause said semi-conductor switch to alternate between said first and said second states repeatedly to produce the electrical multi-pulse signal.

35. A process claimed in claim 34, wherein the steps further include the step of disconnecting the charging system from the charge storage system before operating said wave generator.

* * * * *